United States Patent [19]

Crinquette et al.

[11] Patent Number: 4,887,941

[45] Date of Patent: Dec. 19, 1989

[54] METHOD AND APPARATUS FOR STARTING SERIES-COUPLED VACUUM PUMPS

[75] Inventors: Jean-Marie Crinquette, Annecy Le Vieux; Jacques Long, Annecy, both of France

[73] Assignee: Societe anonyme dite: Alcatel Cit, Paris, France

[21] Appl. No.: 249,154

[22] Filed: Sep. 26, 1988

[30] Foreign Application Priority Data

Sep. 25, 1987 [FR] France ..... 87 13267

[51] Int. Cl.[4] ..... F04B 37/14; F04B 23/08

[52] U.S. Cl. ..... 417/2; 417/53; 417/205; 318/50; 318/102

[58] Field of Search ..... 417/2, 44, 205, 206, 417/53; 318/50, 102

[56] References Cited

U.S. PATENT DOCUMENTS

| | | | |
|---|---|---|---|
| 2,246,932 | 9/1939 | Collins . | |
| 2,295,775 | 9/1942 | Crittenden . | |
| 2,926,835 | 3/1960 | Lorenz | 417/205 |
| 4,140,439 | 2/1979 | Imasu . | |
| 4,699,570 | 10/1987 | Bohn | 417/22 |
| 4,767,280 | 8/1988 | Markuson et al. | 417/44 |
| 4,797,068 | 1/1989 | Hawakawa et al. | 417/205 |

FOREIGN PATENT DOCUMENTS

| | | |
|---|---|---|
| 3208928 | 9/1983 | Fed. Rep. of Germany . |
| 2276487 | 6/1974 | France . |

*Primary Examiner*—Carlton R. Croyle
*Assistant Examiner*—D. Scheuermann
*Attorney, Agent, or Firm*—Sughrue, Mion, Zinn, Macpeak & Seas

[57] ABSTRACT

A method of starting series-coupled vacuum pumps comprising a primary pump (A) and at least one secondary pump (B) connected between the primary pump and an enclosure (E) in which a vacuum is to be established, the method consisting in starting the primary pump initially and subsequently starting the secondary pump when the suction pressure of the primary pump as reduced by rotation of the primary pump reaches an acceptable value, the method being characterized in that the pressure existing in the secondary pump is determined by using a physical magnitude related to the primary pump and following a law similar to the pressure law.

5 Claims, 3 Drawing Sheets

METHOD AND APPARATUS FOR STARTING SERIES-COUPLED VACUUM PUMPS

The present invention relates to a method of starting series-coupled vacuum pumps.

It also relates to apparatus enabling the method to be implemented.

BACKGROUND OF THE INVENTION

In industrial vacuum installations, use is made of a plurality of pumps coupled in series, comprising a primary pump and one or more secondary pumps. These secondary pumps are generally rotary pumps, e.g. pumps of the "Roots," "screw", or "spiral" types. Pump power is limited by thermal and mechanical constraints, and since said power is a function of the pressure difference between the pump's inlet and outlet, these secondary pumps cannot be started at atmospheric pressure. It is necessary to begin by starting the primary pump in order to bring the pressure down to a value which is acceptable for the secondary pump.

In order to determine the instant at which the pressure reaches said acceptable value, a pressure gauge is connected in conventional manner on the suction duct, said gauge being constituted by a pressure-sensitive capsule which, on being deformed, causes an electrical contact to be closed. This contact is connected in the control circuit of the secondary pump and serves to cause it to be started.

This type of pressure gauge withstands corrosion and dust-laden gases poorly, and at low pressures it is sensitive to vibration. Consequently, reliability is poor and this may mean that the secondary pump does not start, or worse it may cause it to start at too a high pressure with the consequent risk of the pump seizing.

The present invention consists in removing the pressure gauge, and thus in not measuring pressure directly, but instead, measuring a physical magnitude which follows a law similar to that of pressure over a given range.

SUMMARY OF THE INVENTION

The present invention provides a method of starting series-coupled vacuum pumps comprising a primary pump and at least one secondary pump connected between the primary pump and an enclosure in which a vacuum is to be established, the method consisting in starting the primary pump initially and subsequently starting the secondary pump when the suction pressure of the primary pump as reduced by rotation of the primary pump reaches an acceptable value, wherein the pressure existing in the secondary pump is determined by using a physical magnitude related to the primary pump and following a law similar to the pressure law.

The present invention also provides starting apparatus for implementing the above method, said apparatus comprising a first electromagnetic relay whose coil is controlled by a manual switch and having three contactors for connecting three phases to the motor of the primary pump, and a second electromagnetic relay serving to switch on the secondary pump, wherein the coil of said secondary relay is powered via a fourth contactor of the first relay, said fourth contactor having a made time delay, and via a contactor of a detector measuring a physical magnitude related to the primary pump and varying as a function of the suction pressure of said pump.

Said detector may be a current relay placed on one of the power supply phases to the primary pump motor, thus indirectly measuring power absorbed. It may alternatively be a vibration detection or a sound level detector placed on the pump, with both of these physical magnitudes (sound level or vibration amplitude) following a law identical to that of the power absorbed.

BRIEF DESCRIPTION OF THE DRAWINGS

A method and associated apparatus in accordance with the invention for a vacuum installation having a single secondary pump are described below by way of example and with reference to the accompanying drawings, in which.

MORE DETAILED DESCRIPTION

Figure 1:
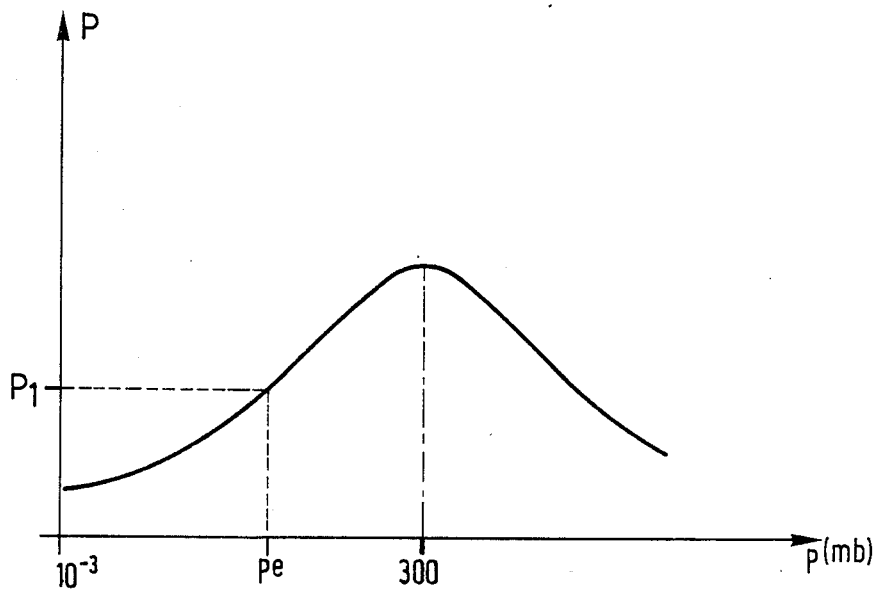
FIG. 1 shows the law obeyed by the power absorbed in the primary pump as a function of its suction inlet pressure.

FIG. 1 shows the curve followed by the power absorbed by the primary pump as a function of its inlet suction pressure. It can be seen that said power falls off beyond a certain threshold equal to 300 millibars and down to the limiting vacuum of $10^{-3}$ millibars.

The primary pump's vibration amplitude and sound level obey equivalent laws.

Figure 2:
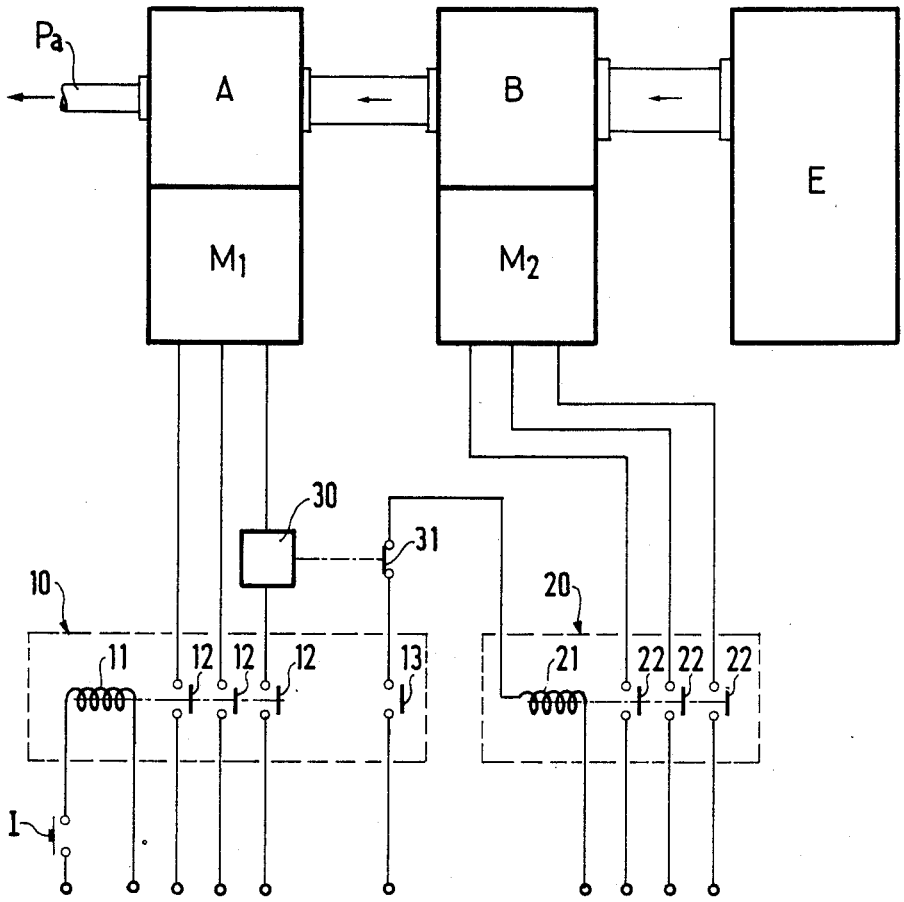
FIG. 2 shows a vacuum installation together with the electricity power supply to two motors, one driving the primary pump and the other driving the secondary pump.

FIG. 2 shows an installation which is stationary, comprising a primary pump A, a secondary pump B, an enclosure E in which a vacuum is to be established, and electricity power supplies for two motors $M_1$, and $M_2$.

In conventional manner, each pump is driven by a three-phase motor and each of the motors receives power via a relay, with the motor $M_1$ of primary pump A being connected via three contactors 12 of a relay 10, and with the motor $M_2$ of secondary pump B being connected via three contactors 22 of a relay 20.

The relay 10 has a coil 11 which is itself powered via a switch I put at the disposition of the operator for starting the primary pump. This relay also includes a fourth contactor 13 which has a made time delay and which is connected in series with a contactor 31 of a detector 30, with the coil 21 of the relay 20 being powered via said two contactors 13 and 31.

In this figure, the detector 30 is a current relay connected in one of the power supply phases to the motor $M_1$ of the primary pump.

Such an operation operates as follows:

When a pumping operation is to be started, primary pump A is started initially by pressing on switch I. Its contactors 12 close and the motor $M_1$ rotates. On starting, the contactor 31 is closed but since the closing of contactor 13 is delayed, the coil 21 of relay 20 is not powered and the motor $M_2$ does not start. The current relay 30 is excited by the motor $M_1$ absorbing a large amount of power, and this causes it to open its contactor 31. The time delay of contactor 13, i.e. the time at which it makes contact, is designed to expire after the contactor 31 has opened, and the coil 21 of relay 20 remains unpowered because the contactor 31 is opened. Once the suction pressure of pump A has reduced to a predetermined threshold, the absorbed power falls off and the feed current also falls off so that the current relay 30 is no longer excited. Its contactor 31 then closes and the coil 21 of relay 20 is powered so its contactors 22 close and pump B is started.

If for any reason the suction pressure of the primary pump increases, the current relay 30 will be excited again and its contactor 31 will open, thereby switching off the power supply to pump B.

Figure 3:
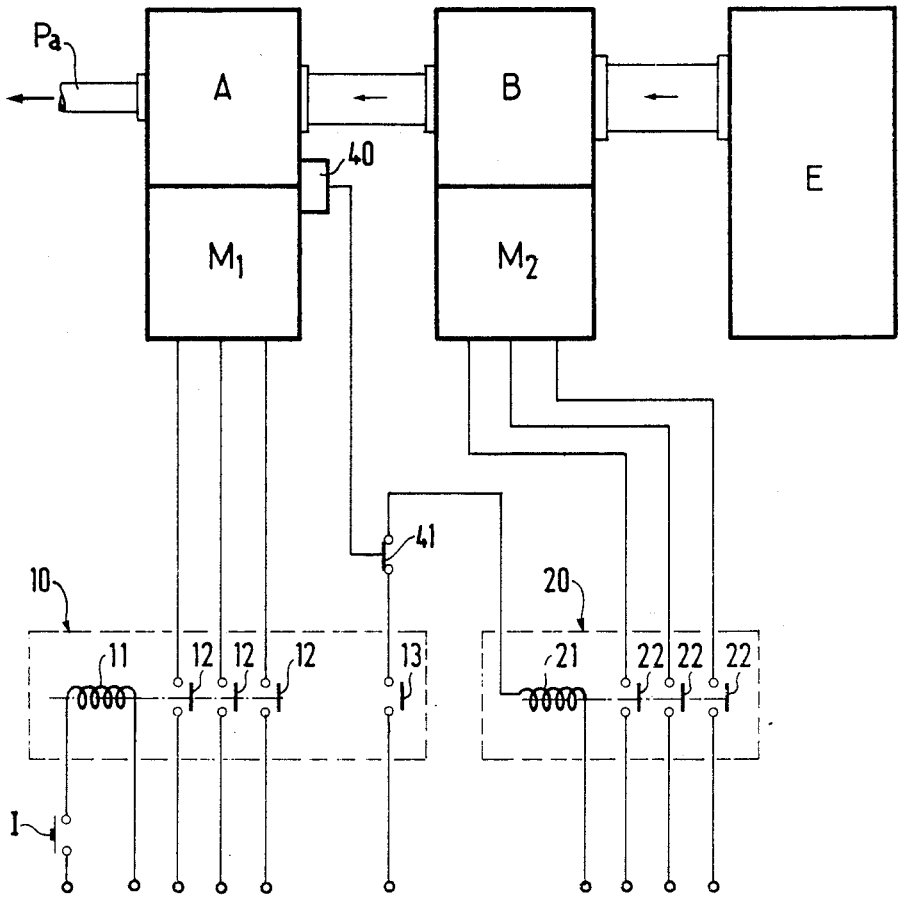
FIG. 3 shows another embodiment of the electricity power supply.

FIG. 3 shows a variant embodiment in which the current relay is replaced by a detector 40 placed on the motor pump group for the purpose of detecting vibration amplitude or sound level and serving to open or close an associated contactor 41.

I claim:

1. Starting apparatus for starting series-coupled vacuum pumps comprising a primary pump and at least one secondary pump connected between the primary pump and an enclosure in which a vacuum is to be established, said primary pump and said secondary pump each having an electric motor for operating the same, a three phase source of electrical power for said electrical motors, a first electromagnetic relay having a coil controlled by a manual switch and having three contactors for connecting the three phases of said electrical power source to the motor of the primary pump and a second electromagnetic relay for switching said electrical power source to the electric motor of said secondary pump, the improvement wherein, a secondary electromagnetic relay connects said electrical power source to said electric motor of said secondary pump, said secondary relay having a coil powered via a fourth contactor of said first relay, said fourth contactor having a make time delay, and via a contactor of a detector measuring a physical operating parameter of said primary pump which varies as a function of primary pump suction pressure whereby, a pumping operation is initiated by energization of said first electromagnetic relay by closure of the three contactors of said first electromagnetic relay, said second electromagnetic relay is not initially energized due to the time delay in closure of said fourth contactor and the electric motor of said secondary pump remains deenergized, and wherein normally, due to the time delay of the fourth contactor, the physical operating parameter of the primary pump reduces in magnitude such that the contactor of the detector closes after expiration of the time delay of said fourth contactor thereby energizing the coil of said secondary relay to connect said electric motor of said secondary pump across said electrical power source, whereby said apparatus eliminates the need for a pressure gage connected to the suction of the primary pump which must withstand corrosion and dust laden gases, which pressure gage is also sensitive to vibration and lacks reliability leading to failure of the secondary pump to start or causing said secondary pump to start at too high a pressure with consequent risks of pump seizing .

2. Apparatus according to claim 1, wherein the detector is a current relay placed in one of the power supply phases to the motor of the primary pump.

3. Apparatus according to claim 1, wherein the detector is a detector for detecting vibration or sound level and placed on one of said primary pump and said primary pump electric motor .

4. A method of starting series-coupled vacuum pumps comprising a primary pump and at least one secondary pump connected between the primary pump and an enclosure in which a vacuum is to be established, said method consisting in the steps of: initially starting the primary pump, sensing a physical operating parameter of said primary pump which varies as a function primary pump suction pressure, and subsequently starting the secondary pump when the suction pressure of the primary pump as reduced by rotation of the primary pump reaches an acceptable value to insure a more effective and relative controlled starting operation of said series-coupled vacuum pumps, wherein said primary pump and said secondary pump are driven by separate electric motors connected to said source of electrical power, and wherein, said step of sensing a physical operating parameter of said primary pump which varies as a function of primary pump suction pressure comprises sensing the electrical current flow to the electric motor of the primary pump during starting.

5. A method of starting series-coupled vacuum pumps comprising a primary pump and at least one secondary pump connected between the primary pump and an enclosure in which a vacuum is to be established, said method consisting in the steps of: initially starting the primary pump, sensing a physical operating parameter of said primary pump which varies as a function primary pump suction pressure, and subsequently starting the secondary pump when the suction pressure of the primary pump as reduced by rotation of the primary pump reaches an acceptable value to insure a more effective and relative controlled starting operation of said series-coupled vacuum pumps, wherein said primary pump and said secondary pump are driven by separate electric motors connected to a source of electrical power, and wherein said step of sensing a physical operation parameter of said primary pump which varies as a function of primary pump suction pressure comprises detecting the vibration or sound level of one of said primary pump and said primary pump electric motor.

* * * * *